United States Patent [19]

Hanson

[11] 4,317,296

[45] Mar. 2, 1982

[54] BOOT SHELL AND LINER

[75] Inventor: Chris A. Hanson, Boulder, Colo.

[73] Assignee: Hanson Industries Incorporated, Boulder, Colo.

[21] Appl. No.: 130,197

[22] Filed: Mar. 13, 1980

[51] Int. Cl.[3] ..... A43B 5/04; A43B 21/00

[52] U.S. Cl. ..... 36/121; 36/105

[58] Field of Search ..... 36/117, 118, 119, 120, 36/121, 105

[56] References Cited

U.S. PATENT DOCUMENTS

| | | | |
|---|---|---|---|
| 3,868,783 | 3/1975 | Caporicci | 36/120 |
| 3,895,452 | 7/1975 | Hanson et al. | 36/117 |
| 4,083,127 | 4/1978 | Hanson | 36/117 |
| 4,083,130 | 4/1978 | Bertetto et al. | 36/117 |
| 4,143,474 | 3/1979 | Blanc | 36/120 |

*Primary Examiner*—Patrick D. Lawson

*Attorney, Agent, or Firm*—Merriam, Marshall & Bicknell

[57] ABSTRACT

An article of footwear, particularly a ski boot or the like, having an integral one-piece shell molded from a relatively rigid plastic material. The shell has a lengthwise split in the cuff portion to provide overlapping flap members which completely enclose the wearer's foot. The flap members are resiliently spreadable for insertion or removal of the wearer's foot. The front of the shell has a depending skirt portion with a lower free edge which overlies a rearwardly extending vamp. The skirt portion has a downwardly opening slot with adjustable transverse fastener means for flex control at the front of the shell. The cuff portion of the shell is assymetrical at its upper end so that the shell is higher at the inside and the rear than at the outside and the front. An integral one-piece liner of soft flexible material is disposed within the shell. The liner is split lengthwise to permit spreading of the liner when the flap members of the shell are spread apart.

15 Claims, 7 Drawing Figures

FIG.1
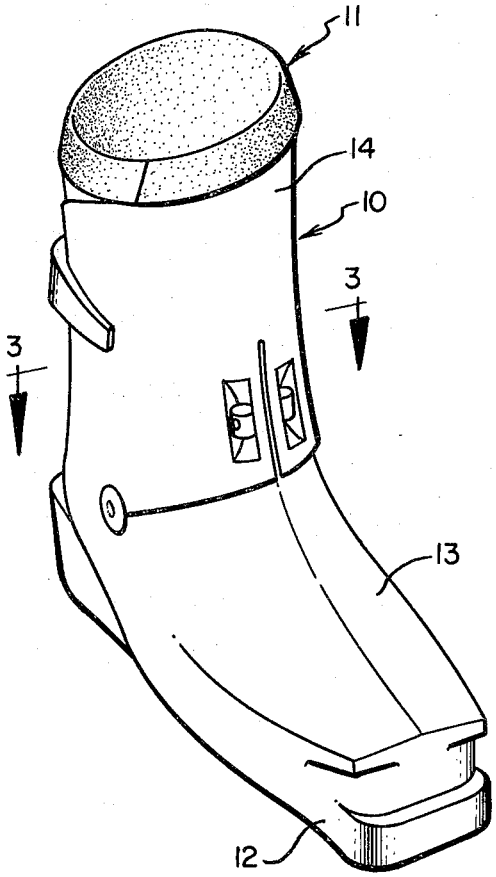
FIG.2
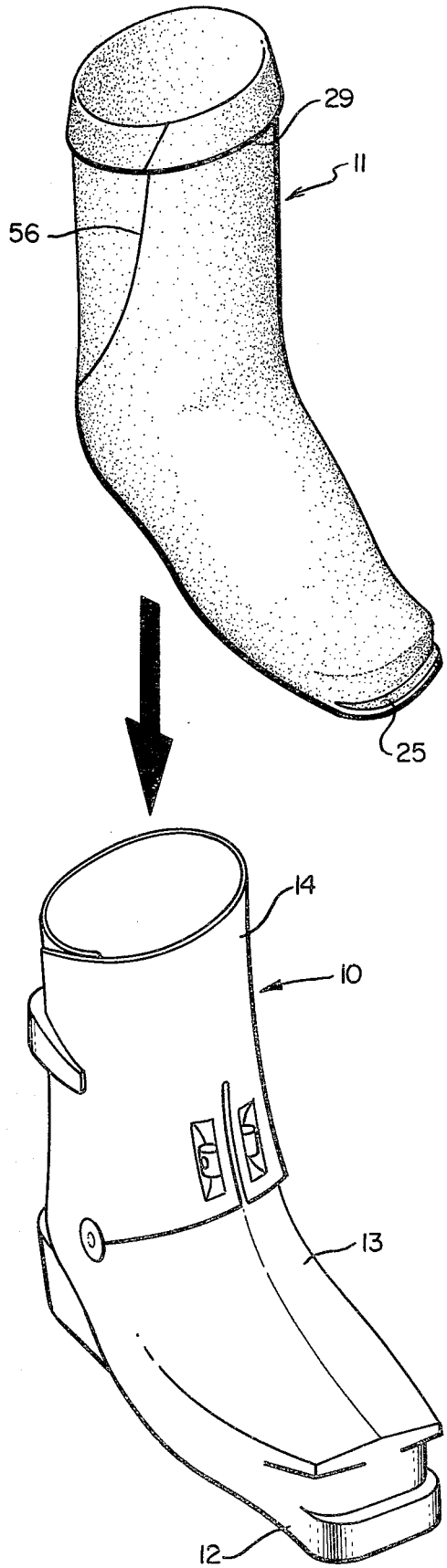
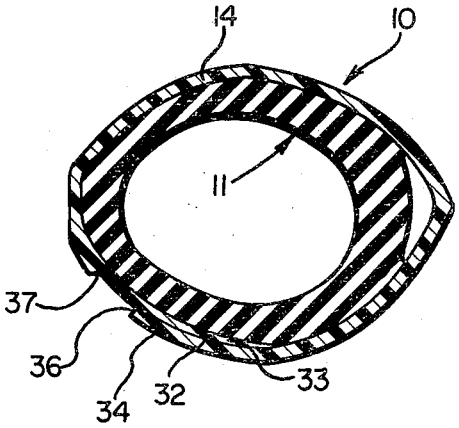
FIG.3

BOOT SHELL AND LINER

This invention relates to improvements in an article of footwear, more particularly sports footwear such as ski boots and the like.

The customary rear entry ski boot comprises a substantially rigid outer shell of plastic material and an inner liner of soft flexible material, typically a foamed plastic such as polyurethane foam. In one commonly used type of boot, the shell has a multiple part construction in which preformed portions of the shell are held in assembled relation by rivets or other fastening means, and a rear entry opening in the assembled shell is closed by a pivotally mounted tongue. The tongue has a separate liner section which cooperates with the liner section in the assembled shell to provide a complete liner for the boot when the tongue is closed.

The aforementioned multiple part boot construction requires a plurality of molds for forming the various parts of the shell and liner, and the resultant manufacturing and assembly costs are substantial.

Accordingly, a primary object of the present invention is to provide a novel and improved construction for a ski boot or the like which is characterized by an integral one-piece outer shell.

A further object of the invention is to provide a novel and improved construction for a ski boot or the like which is characterized by an integral one-piece liner.

An additional object of the invention is to provide a novel and improved ski boot or the like having an integral one-piece outer shell of relatively rigid material and an integral one-piece inner liner of soft flexible material, whereby increased convenience of manufacture and reduced manufacturing costs are realized.

Other objects and advantages of the invention will be evident from the following detailed description in conjunction with the accompanying drawings, wherein:

FIG. 1 is a perspective view of a ski boot comprising a specific embodiment of the invention;

FIG. 2 is an exploded perspective view of the boot shown in FIG. 1 with the outer shell and inner liner of the boot in separated relation;

FIG. 3 is a transverse sectional view taken substantially along the line 3—3 of FIG. 1;

Figure 5:
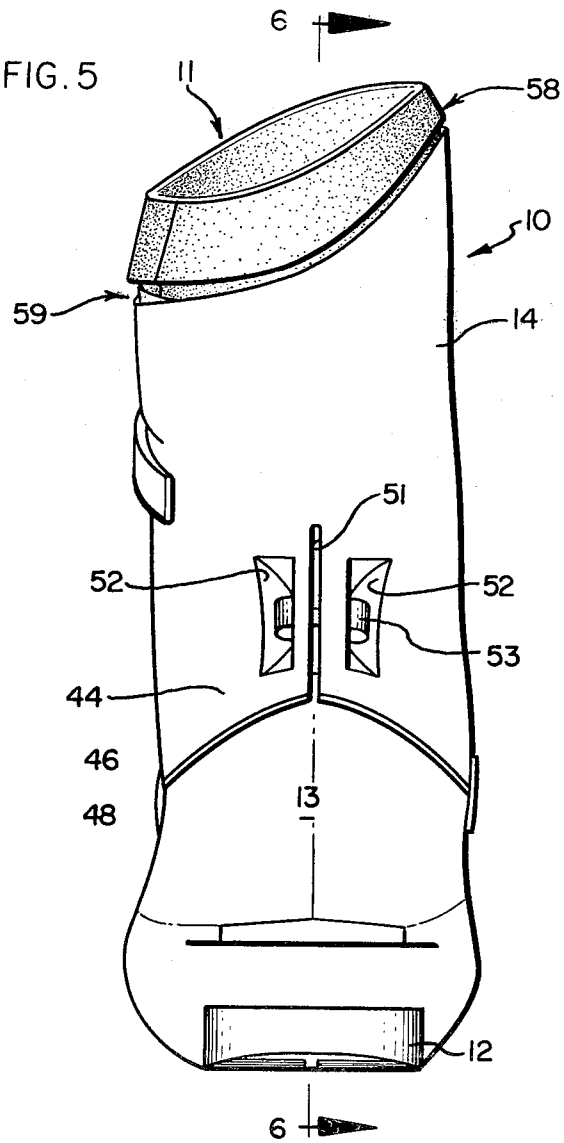
FIG. 5 is a front elevational view of the boot shown in FIG. 4.

The ski boot shown in the drawings has an integral one-piece outer shell designated generally at 10 and an integral one-piece liner designated generally at 11. The shell 10 is molded from a suitable relatively rigid plastic material, and the liner 11 is molded from a soft flexible material such as polyurethane foam.

The shell 10 has an integral one-piece configuration, including a sole portion 12 at the bottom of the shell, an intermediate foot and ankle enclosing portion 13, and an upstanding tubular cuff portion 14 at the top of the shell which is adapted to extend a substantial distance above the wearer's ankle.

Figure 6:
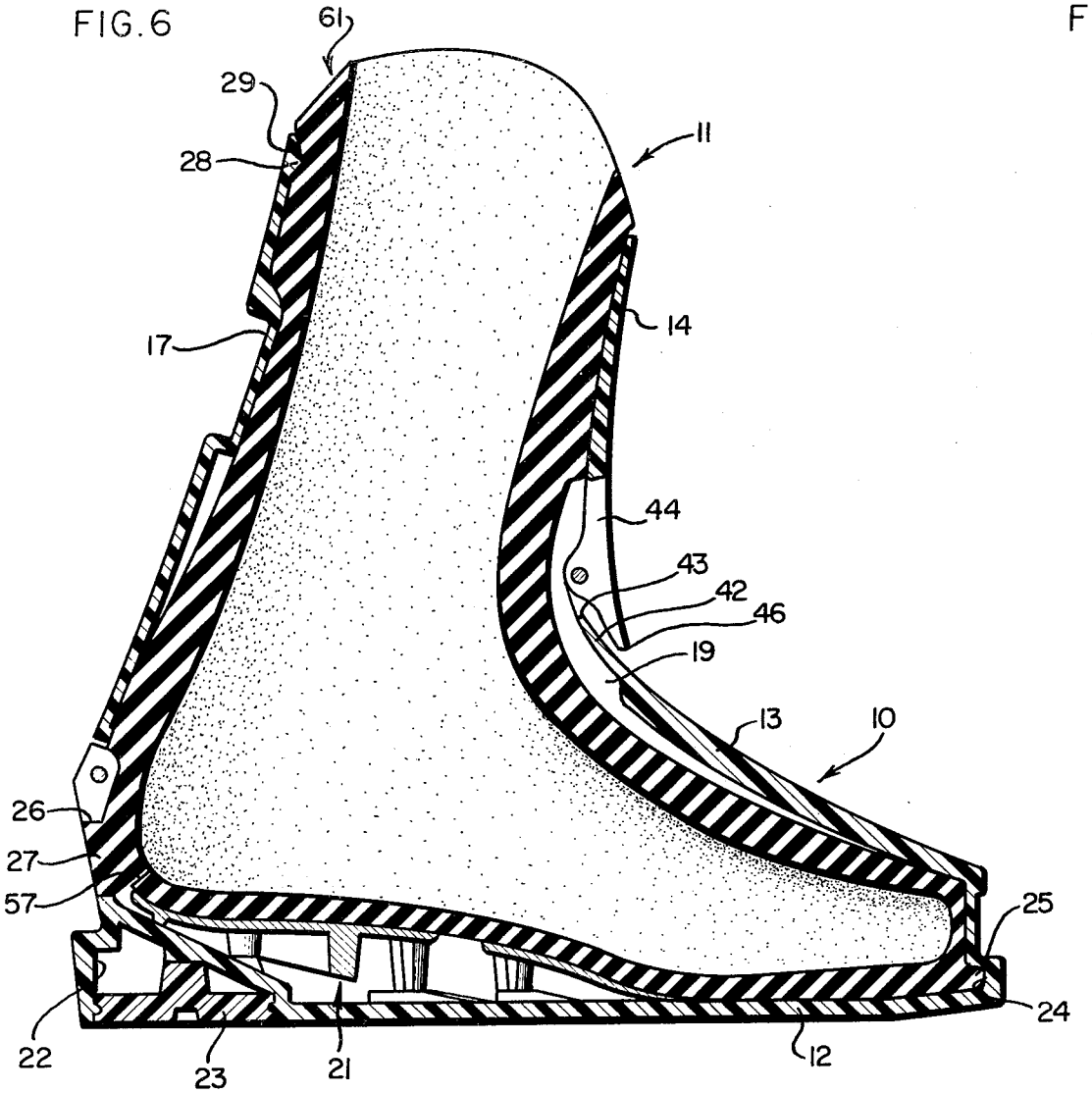
FIG. 6 is a vertical sectional view as seen substantially along the line 6—6 of FIG. 5.

As seen in FIG. 6, the liner 11 is shaped so that its outer surface conforms generally to and fits snugly against the inner surface of the shell 10 except in selected regions where cavities are provided between the shell and the liner which are filled with suitable fitting pads to provide enhanced comfort and support. For example, as shown in FIG. 6, the liner 11 and the portion 13 of the shell 10 are contoured in the vamp region of the boot to provide an enlarged cavity containing a fitting pad 19 which overlies the front and arched instep regions of the wearer's foot. The pad 19 may be of any suitable material, e.g. a thermoplastic material as disclosed in U.S. Pat. Nos. 3,798,799 and 3,882,561 or a preformed pad of the type disclosed in U.S. Pat. No. 4,083,127.

A special arch support structure 21 (FIG. 6) may also be interposed in a cavity between the sole portion 12 of the shell 10 and the corresponding sole portion of the liner 11. The rear end of the sole portion 12 has a downwardly opening cavity 22 in which a replaceable heel pad 23 is mounted. The arch support structure 21 is more fully described and claimed in my copending application Ser. No. 130,200, filed concurrently with this application.

The one-piece liner 11, although readily removable from the shell 10, is retained in place within the shell 10 by means of a plurality of interfitting portions. For example, as seen in FIG. 6, at the toe of the boot the sole portion 12 of the shell 10 has a peripheral recess 24 receiving a complementary projecting portion 25 on the sole of the liner 11. Likewise, the rear of the portion 13 of the shell 10 is provided with an enlarged circular opening 26 closely adjacent the heel of the boot, and a projecting button portion 27 of the liner 11 extends into the opening 26. Of course, the vamp area of the shell portion 13 which overlies the front portion of the wearer's foot also cooperates with the spaced underlying sole portion 12 to provide an elongated pocket which receives and retains the corresponding portion of the liner 11. In addition, as also seen in FIG. 6, the upper end of the cuff portion 14 of the shell 10 is provided with a shallow, circumferentially extending, inwardly projecting bead or ridge 28 which extends into a complementary groove 29 in the adjacent area of the liner 11 to retain the latter in place in the shell.

As previously mentioned, the usual-entry ski boot heretofore available has been provided with a pivotal tongue at the rear of the shell to open and close a rear opening in the shell. Conventionally, the tongue is a separately molded element having a pivoted fit or connection with the shell body adjacent the heel portion of the boot. In accordance with the present invention, however, the one-piece shell 10 has a split configuration with resiliently overlapping curved flap portions such that the entire boot, including the rear, is substantially closed, but entry of the wearer's foot is permitted by manually spreading apart the overlapping flap portions.

Figure 7:
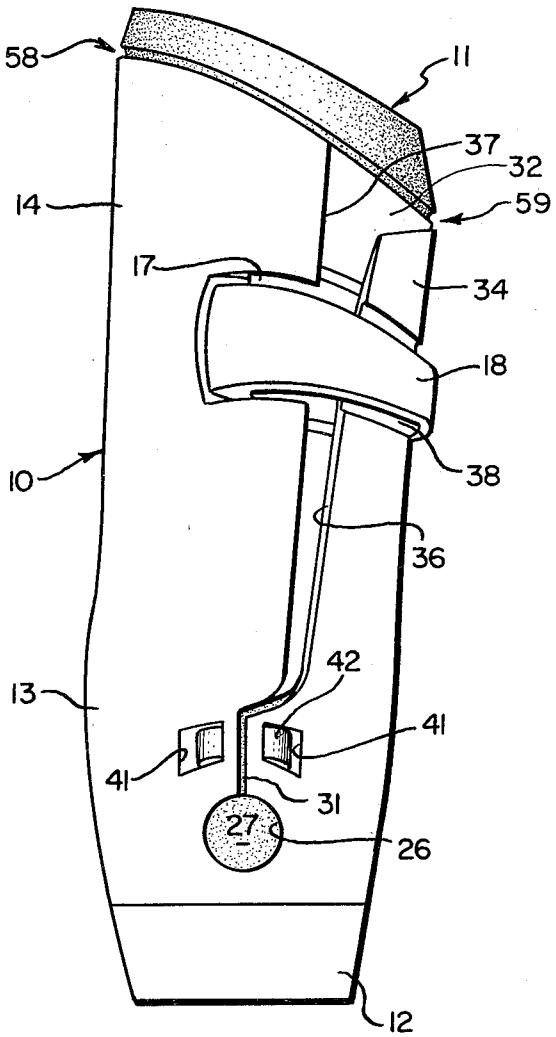
FIG. 7 is a rear elevational view of the boot shown in FIG. 4.

Thus, as seen in FIG. 7, the rear wall of the shell 10 is formed with a narrow slot which extends vertically upwardly from the opening 26, as at 31. The split shell 10 has an integral, generally triangular, inner flap member 32 extending forwardly from the rear of the shell along the outside of the boot and terminating along an inclined forward edge 33 (FIG. 4) which extends from one edge of the slot 31 to the top edge of the cuff portion 14 of the shell. The remaining portion of the split shell provides an integral outer flap member 34 extending rearwardly from the front of the shell along the outside of the boot and terminating along a rearward edge 36 which extends from the opposite edge of the slot 31 to the top of the boot.

Figure 4:
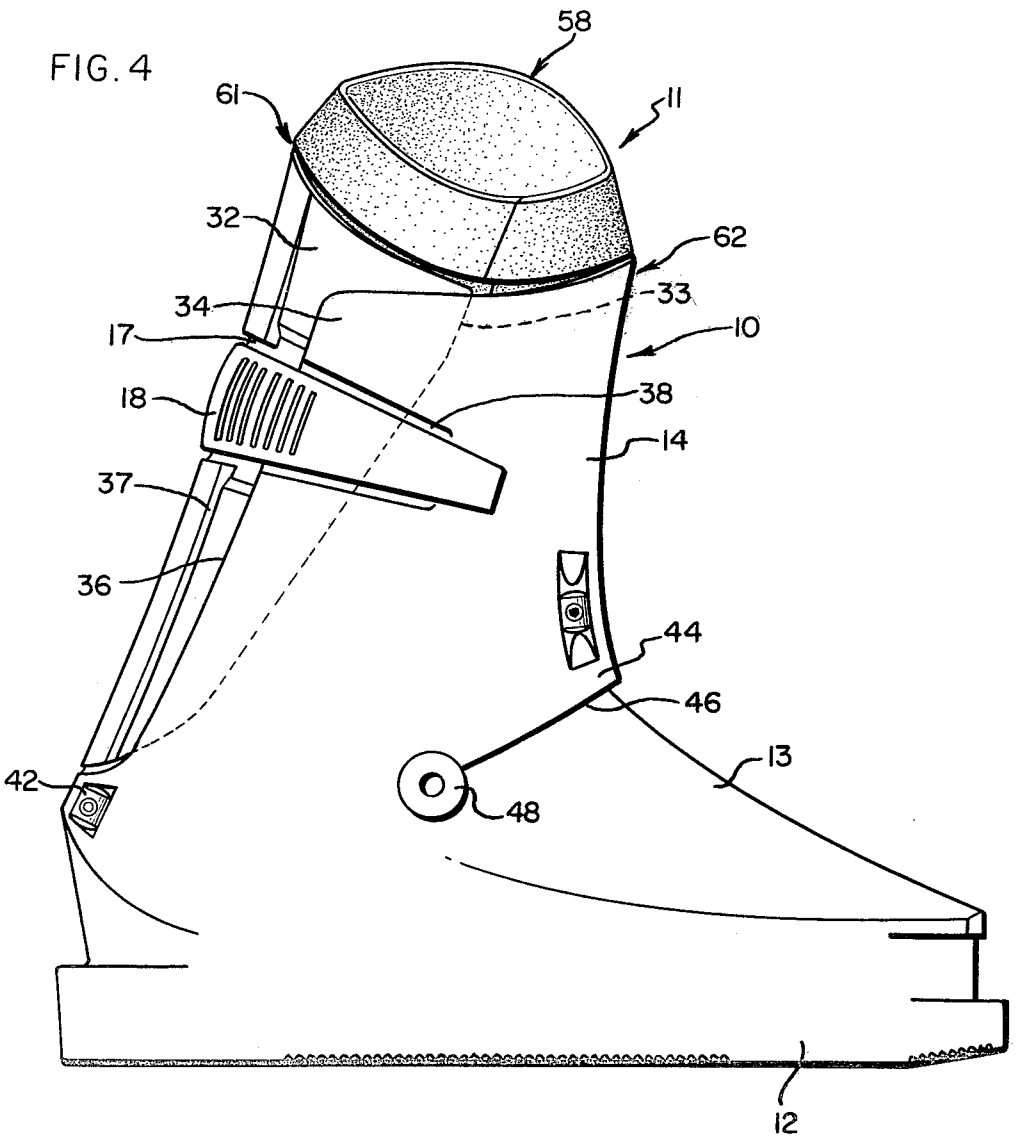
FIG. 4 is a side elevational view from the outside of the boot as viewed looking to the right of FIG. 1.

As shown in FIGS. 3, 4, and 7, the outer flap member 34 snugly overlaps the inner flap member 32 to a substantial extent so as to provide a closed shell encircling the ankle of the wearer's foot. As best seen in FIG. 3, the inner flap member 32 has a reduced wall thickness so as to define an upright shoulder 37 at the rear wall of the shell. Thus, the combined thickness of the overlapped flap members 32 and 34 is not excessive, and the rearward edge 36 of the outer flap member 34 is spaced from the shoulder 37 when the flaps are closed. Because of the split construction, however, the flap members 32 and 34 are resiliently spreadable at the rear of the boot to facilitate insertion or removal of the foot through the cuff portion 14. The slot 31 and enlarged opening 26 provide adequate distribution of the stress in the shell during spreading of the flaps so as to avoid fracture or failure of the shell during normal usage. The enlarged opening 26 also functions to distribute stress in the shell during the molding of the shell, particularly during removal of the completed one-piece shell from the mold.

A closure 18 is movably affixed to the rear of the shell 10 and is received in a recess 17. The opposite end of the closure 18 overlies the flap member 34 and is received in a companion recess 38 in the flap surface. The closure 18 holds the flaps 32 and 34 in closed position when the boot is on the wearer's foot but is releasable when desired. Recesses 41 are formed in the shell 10 at opposite sides of the slot 31 to receive an adjustable fastener 42 for regulating the flex of the shell in the heel region of the boot. The closure 18 and the heel flex control are more fully described and claimed in my copending applications Ser. Nos. 130,198 and 130,195, filed concurrently with this application.

Although the split overlapping portions of the shell 10 are located and arranged to permit enlargement at the rear of the boot in the illustrated embodiment of the invention, it is also possible to provide the split overlapping shell portions at the front or side of the boot with the same attendant advantages.

The shell 10 also includes a discontinuous region extending laterally over the arched instep region of the boot. Thus, as best seen in FIGS. 4–6, the top wall of the vamp portion of the boot extends rearwardly from the toe of the boot and terminates in a marginal portion 42 of reduced thickness having a laterally extending edge 43 which overlies the instep region. The cuff portion 14 at the front of the boot extends downwardly as a depending skirt portion 44 having a laterally extending lower edge 46 so that the skirt portion 44 overlies the portion 42 thereby fully enclosing the front of the boot. The skirt portion 44 is integrally joined to the foot and ankle enclosing portion 13 of the shell at the extremities of the skirt edge 46, and an enlarged circular opening (not shown but similar to the opening 26) is provided in the shell 10 at each of these junctures in order to distribute the stresses during flexure of the shell. Removable grommets 48 of rubber or the like are mounted in these openings to seal the same.

A downwardly opening flex channel or slot 51 is formed in the center of the skirt portion 44 and extends upwardly from the edge 46 a sufficient distance to permit resilient flexing and spreading of the split skirt during use. A pair of recesses 52 are formed in the skirt portion 44 at opposite sides of the slot 51, and an adjustable fastening means 53 is received inthe recesses 52 and extends through a selected pair of a plurality of aligned apertures (not shown) in the recessed areas to imit the extent of flexure. By moving the fastening means 53 downwardly to a lower set of aligned apertures, the extent of flexing is further restricted and the stiffness of the boot is increased. The foregoing structure at the front of the shell 10 is described more fully and claimed in my copending application Ser. No. 130,199, filed concurrently with this application.

The liner 11 has an integral one-piece construction, but in order to facilitate insertion and removal of the wearer's foot, the liner is slit along a line 56 (FIG. 2) from the top edge of the liner cuff downwardly and rearwardly in a curved path to the sole of the liner. As seen in FIG. 2, the split portions of the liner are butted together, but if desired the split portions may be slightly overlapped adjacent the top of the liner cuff with the extent of overlapping decreasing progressively to a simple butt joint 57 (FIG. 6) at the sole of the liner. As will readily be understood, when the overlapping flaps of the shell 10 are spread apart to accommodate insertion or removal of the wearer's foot, the split construction of the liner 11 also permits simultaneous spreading of the liner along the slit line 56.

An additional advantageous feature of the invention is found in the assymetrical configuration of the shell 10 and liner 11 adjacent the upper edge of the cuff of the boot. As most clearly shown in FIGS. 4, 5, and 7, the shell 10 and liner 11 are substantially higher at the inner side 58 of the boot than on the outer side 59 in order to impart increased support at the inside of the wearer's leg. This increased support provides improved safety and control during certain skiing maneuvers, particularly during "edging". As also seen in FIGS. 4, 5, and 7 the shell 10 and liner 11 are preferably higher at the rear 61 than at the front 62 for improved stability and support.

Although the invention has been described with particular reference to the illustrated specific embodiment, it is to be understood that various modifications and equivalent structures may be utilized without departing from the scope of the invention as defined in the appended claims.

I claim:

1. In an article of footwear of the class described, the improvement comprising an integral one-piece outer shell molded from a relatively rigid plastic material and including a sole portion at the bottom of the shell, a tubular cuff portion at the top of the shell, and an intermediate foot and ankle enclosing portion; said shell having a single split extending generally lengthwise from the top of said cuff portion and terminating above said sole portion, and the regions of the shell adjoining the split being shaped to provide a pair of curved flap members overlapping to a substantial extent so as to provide a substantially closed shell encircling the ankle of a wearer's foot; said flap members being resiliently spreadable to facilitate insertion or removal of a foot through said cuff portion; and closure means mounted on said shell for releasably retaining said flap members in overlapping closed position.

2. The article of claim 1 further characterized in that said split in said shell is located and arranged to permit resilient spreading of said flap members and enlargement of the shell at the rear of said article.

3. The article of claim 1 further characterized in that said shell is fitted with an inner liner of soft flexible material, said liner having an integral one-piece construction including a sole portion, a foot and ankle enclosing portion, and a cuff portion conforming generally to the corresponding portions of said shell; and said liner having a single split extending generally lengthwise from the top of its cuff portion and terminating adjacent its sole portion so as to permit the liner to be spread apart when said flap members of said shell are spread apart.

4. In an article of footwear of the class described, the improvement comprising an integral one-piece shell molded from a relatively rigid plastic material and including a sole portion at the bottom of the shell, a tubular cuff portion at the top of the shell, and an intermediate foot and ankle enclosing portion; said shell being split generally lengthwise extending from the top of said cuff portion and terminating above said sole portion, and the regions of the shell adjoining the split being shaped to provide a pair of curved overlapping flap members; said flap members being resiliently spreadable to facilitate insertion or removal of a foot through said cuff portion; and closure means mounted on said shell for releasably retaining said flap members in closed position; the split in said shell including a short vertical slot at the rear of the shell having spaced edges, one of said edges continuing from the upper end of said slot to the top of said cuff portion to define a forwardly extending flap member, and the other of said edges continuing from the upper end of said slot to the top of said cuff portion to define a rearwardly extending flap member.

5. The article of claim 4 further characterized in the said spaced edges at the lower end of said slot extend into an enlarged opening at the rear of said shell for distributing stress in the shell during manipulation of said flap members.

6. The article of claim 4 further characterized by the provision of adjustable fastener means extending across said slot at the rear of the shell to regulate the extent of flexing of the shell at said slot.

7. The article of claim 1 further characterized in that the front of said shell has a discontinuous region extending laterally across the instep and comprising a top wall extending rearwardly from the toe of the article and terminating in a laterally extending free edge, and a skirt portion depending from said cuff portion and overlying said free edge, said skirt portion having a downwardly opening slot for providing flexibility in the front region of the shell.

8. The article of claim 7 further characterized by the provision of adjustable fastener means extending across said slot in said skirt portion to regulate the extent of flexing of the shell at said slot.

9. The article of claim 1 wherein the upper end of said tubular cuff portion of said shell is assymetrical with said cuff portion being higher at one side thereof corresponding to the inside of the wearer's foot than at the opposite side thereof.

10. The article of claim 9 further characterized in that said cuff portion is also higher at the rear thereof than at the front thereof.

11. The article of claim 3 further characterized in that said shell and said liner have interfitting portions for removably retaining the liner in place within the shell.

12. The article of claim 11 further characterized in that said interfitting portions include a peripheral internal recess in the sole portion of the shell adjacent the toe of the article and a complementary projecting portion on the sole portion of the liner, said projecting portion being received within said recess.

13. The article of claim 11 further characterized in that said interfitting portions include a circumferentially extending, inwardly projecting bead adjacent the upper end of the cuff portion of the shell and a complementary groove in the adjacent area of the liner, said bead extending into said groove.

14. The article of claim 4 further characterized in that said forwardly extending flap member is innermost and said rearwardly extending flap member is outermost and overlies said forwardly extending flap member.

15. The article of claim 5 further characterized in that said shell is fitted with a removable inner liner of soft flexible material, said liner having a rearwardly projecting portion extending into said enlarged opening at the rear of the shell for removably retaining the iner in place within the shell.

* * * * *

UNITED STATES PATENT AND TRADEMARK OFFICE

CERTIFICATE OF CORRECTION

PATENT NO. : 4,317,296

DATED : March 2, 1982

INVENTOR(S) : Chris A. Hanson

It is certified that error appears in the above-identified patent and that said Letters Patent are hereby corrected as shown below:

Col. 3, line 66, change "inthe" to --in the--;

Col. 3, line 68, change "imit" to --limit--;

Col. 6, line 40, change "iner" to --liner--.

Signed and Sealed this

Tenth Day of August 1982

[SEAL]

Attest:

GERALD J. MOSSINGHOFF

Attesting Officer

Commissioner of Patents and Trademarks